United States Patent [19]

Lombard

[11] Patent Number: 4,964,604

[45] Date of Patent: Oct. 23, 1990

[54] HANGING BRACKET FOR CURTAIN RODS

[76] Inventor: Emile Lombard, 145 Sun Valley Dr., Slidell, La. 70458

[21] Appl. No.: 456,462

[22] Filed: Dec. 26, 1989

[51] Int. Cl.[5] ..... A47H 1/10

[52] U.S. Cl. ..... 248/262; 160/330

[58] Field of Search ..... 248/262, 263, 264, 265; 160/330

[56] References Cited

U.S. PATENT DOCUMENTS 2,679,373 5/1954 Henley ..... 248/262

*Primary Examiner*—Reinaldo P. Machado

*Attorney, Agent, or Firm*—Pravel, Gambrell, Hewitt, Kimball & Krieger

[57] ABSTRACT

A mounting bracket for curtains, which includes a first face of the bracket which would be positioned against the front face of a window molding; a mounting hook extending outwardly from the face of the bracket, for mounting a curtain rod thereupon; a first arm extending rearwardly from the top portion of the face, to a depth substantially the thickness of a window molding; a second arm extending along rearwardly from the side of the face also of a depth substantially the thickness of the window molding; a first downward depending tooth member extending downwardly from that arm extending rearwardly from the top portion of the bracket, and a second tooth member extending inwardly from that arm extending rearwardly from the side of the bracket, so that when the inwardly depending tooth is engaged into the side wall of the molding, and the downward depending tooth member is engaged into the upper wall of the molding, the bracket is secured onto the molding without the need for mounting screws or the like.

9 Claims, 1 Drawing Sheet

HANGING BRACKET FOR CURTAIN RODS

BACKGROUND OF THE INVENTION

1. Field of the Invention

The apparatus of the present invention relates to curtain rods. More particularly, the present invention relates to an apparatus which is attachable to the corner of a window molding without the use of mounting nails or screws, which will accommodate a curtain rod thereupon after the bracket has been placed into position.

2. General Background

It is commonly known in the art of curtain hanging, that one of the more common types of rods are the type that are substantially flat and form an "L" bend at each end of the rod, so that once the curtain has been placed onto the rod, the rods are attached to a bracket along the corners of the opening, for example a window, and the curtain is therefore hanging from the window, yet moved apart from the frame of the window so as to allow free hanging of the curtains. Normally, these types of rods would include at their end portions an opening within the rod body, so that the end of the rod may slip around a bracket, with the upper point of the bracket engaging a port in the upper wall of the rod, so that the rod is attached to the bracket securely. These types of brackets are quite well known and have been used for many years.

One of the concerns of these types of brackets are the fact that these brackets normally have a rear face which would include a pair of ports in the face, for accommodating mounting tacks or screws through the ports, for allowing the bracket to be secured to the corner of the window molding, so that curtains may be hung thereupon. It is therefore necessary that normally a pair of holes be bored into the face of the window or door molding, and screws or nails be threadably engaged into the molding so that the bracket is held secure. This is often times quite unsightly, particularly when the brackets must be removed for any reason, and the molding facing the interior cf the room is flawed with holes in the corner that were once accommodating the curtain brackets. Therefore, there is a need for a new and improved type of bracket which may be mounted in a different fashion so as to allow the bracket to be easily secured onto the face of the molding without the molding being blemished.

SUMMARY OF THE PRESENT INVENTION

The apparatus of the present invention solves the problem in the art in a simple and straightforward manner. What is provided is a mounting bracket for curtains, which includes a first face of the bracket which would be positioned against the front face of a window molding; a mounting hook extending outwardly from the face of the bracket, for mounting a curtain rod thereupon; a first arm extending rearwardly from the top portion of the face, to a depth substantially the thickness of a window molding; a second arm extending along rearwardly from the side of the face also of a depth substantially the thickness of the window molding; a first downward depending tooth member extending downwardly from that arm extending rearwardly from the top portion of the bracket, and a second tooth member extending inwardly from that arm extending rearwardly from the side of the bracket, so that when the inwardly depending tooth is engaged into the side wall of the molding, and the downward depending tooth member is engaged into the upper wall of the molding, the bracket is secured onto the molding without the need for mounting screws or the like.

Therefore, it is a principal object of the present invention to provide a bracket for mounting curtain rods, which eliminates the use of mounting screws or nails;

It is a further object of the present invention to provide an improved bracket for mounting curtain rods, which can be secured to the molding around a window or door opening, by attaching the bracket to a portion of the molding which is not visible to the naked eye when the bracket is removed; and It is a further object of the present invention to provide a curtain rod hanging bracket which can be secured to the corner of a window molding with a pair of mounting teeth insertable into the rear face of the molding and therefore eliminating the need for mounting nails or screws and maintaining the molding in an unblemished state.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIGS. 1A through 2E illustrate side, bottom, rear, front, and top views respectively;

DETAILED DESCRIPTION OF THE PREFERRED EMBODIMENT

Figure 5:
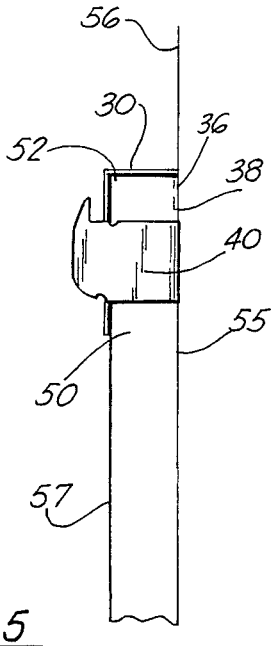
FIG. 5 illustrates a side view of the preferred embodiment of the apparatus of the present invention mounted onto a window molding.

The preferred embodiment of the apparatus of the present invention is illustrated by the numeral 10. As illustrated, more particularly in the Figures, apparatus 10 comprises a first flat base portion 12, having a forward face 14 and a rear face 16. The base portion 12 would have a curtain rod hanging means 18 extending outwardly from one edge of base portion 12, hanging means 18 being a typical curtain rod hanger having a body portion 20, and an upper tooth portion 22, for engaging a port in the wall of the curtain rod for supporting thereupon. This type of hanger 18 is a typical type of curtain hanger, and is quite well known in the art. The present invention would further comprise a first bracket support means 30, and a second bracket support means 40, each of the support means 30, 40, defining a means of supporting the bracket onto the corner of a window sill as illustrated in FIG. 5.

As illustrated, hanging means 30 comprises a first body portion 32 extending rearwardly of the rear face 16 of base 12, and being of substantially the same width of base 12. Body portion 30 would extend a distance substantially the thickness of a typical window molding 50, as illustrated in FIG. 5. The outer most end 34 of body 30 would include a downward depending tooth member 36, substantially triangular in shape, and ending in a point 38, that would assist in easing the insertion of tooth 36 into the window molding 50, as illustrated in FIG. 5.

Figure 3:
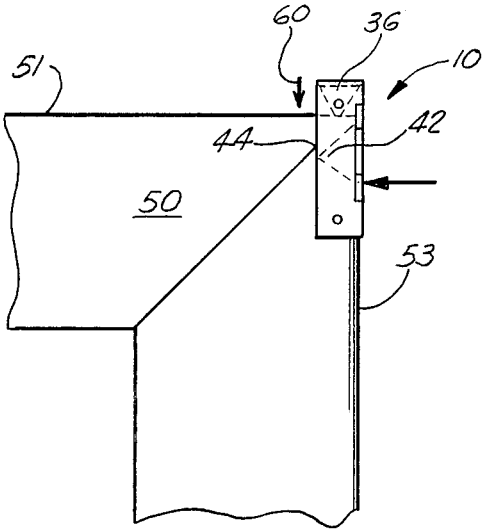
FIG. 3 illustrates the preferred embodiment of the apparatus of the present invention while being mounted onto window molding.

The second body portion 40 would extend rearwardly from the side edge 15 of principal body portion 12, and likewise would extend rearwardly at substantially the same distance as body portion 30, and would terminate in an inwardly depending tooth member 42, again substantially triangular in shape, and having a point 44 for likewise easing the insertion of tooth 42 into the window molding 50, as illustrated in FIG. 3.

It should be noted that for purposes of construction, the apparatus as seen in the Figures is the apparatus that would be adaptable to the right corner 52 of a window molding, in view of the fact that the rearward extending tooth body portion 40 is extending from the right edge 15 of the body 12, and tooth member 42 is depending inwardly towards the left, therefore being insertable into the right edge 53 of window molding 50, as illustrated in FIG. 3. Therefore, there would be required a second apparatus 10 positionable on the left corner (not illustrated) so that the left end of the rod may be hung from the left corner of the sill. In order to accomplish this, apparatus 10 would have the body portion 40 and the hook member 18 extending from the left edge 17 of body member 12, so that the apparatus may be positioned onto the left corner of the window molding so as to have a pair of brackets.

Figure 1:
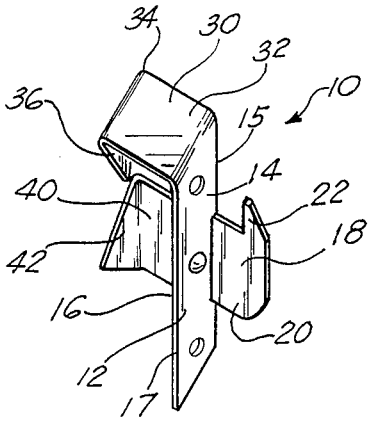
FIG. 1 illustrates an overall view of the preferred embodiment of the present invention.
Figure 2E:
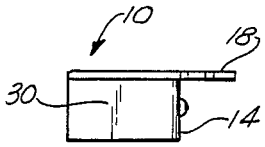
Figure 2D:
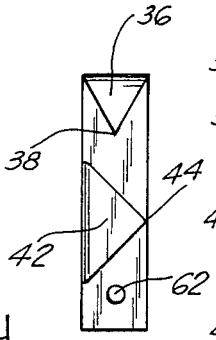
Figure 2A:
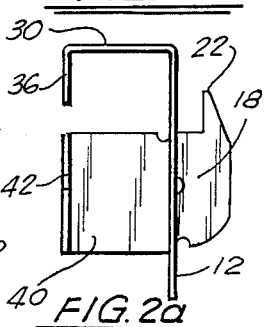
Figure 2C:
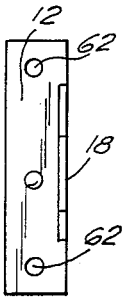
Figure 2B:
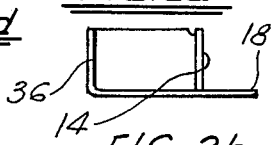
Figure 4:
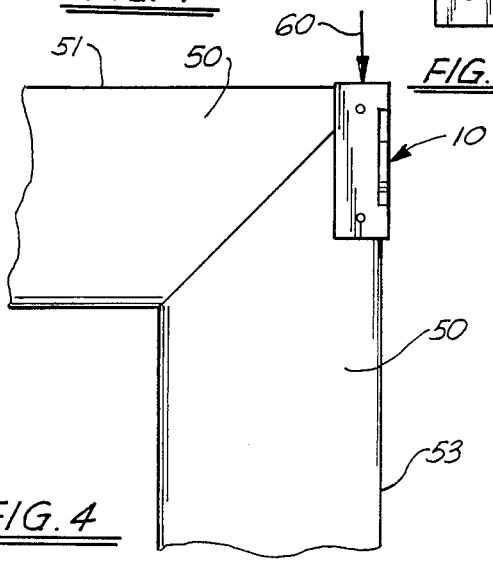
FIG. 4 illustrates the completion of the mounting of the preferred embodiment of the apparatus of the present invention.

FIGS. 3, 4, and 5 illustrate the preferable steps in the mounting of apparatus 10 to both assure the firm positioning of the apparatus onto window molding 50, and the reduction in the blemishing of the window molding when the apparatus is inserted in place. As illustrated in FIG. 3, in the preferred embodiment, the apparatus 10 would be positioned with downwardly depending tooth member 36 pointing along the top edge 51 of window molding 50, so that tooth member 42, facing inwardly into the frame 50 would be forced into the right edge 53 of the window frame, as illustrated in FIG. 3. Following the insertion of tooth 42 into the frame as illustrated, then the apparatus would be forced downwardly in the direction of Arrow 60, so that tooth 36 would be forced downwardly into the top edge 51 of window molding 50, to be placed in position as seen in front view in FIG. 4, and in side view in FIG. 5. It is important that the downward depending tooth 36 be inserted following the insertion of inwardly depending tooth member 42, in view of the fact that the bracket would be unsecurely mounted if the tooth 36 were driven in first and then the tooth 42 would be driven in next, creating a gap between the corner of the molding and the position of tooth 36 within the molding.

As is illustrated, it is foreseen that if one wishes to, there could be provided a secondary means, bore 62 in the face of body portions 30 and 40 of apparatus 10, so as to provide the use of thumb tacks through bore 62 into the edges 51 and 53 of window molding 50 to ensure an even firmer mounting, and that is completely out of view, and would leave no marks after the brackets have been removed from the molding. This may be done in the event of a curtains hanging from the rod are quite heavy and would assure that the apparatus would be maintained in place. However, for the most part, the apparatus would be easily and securely mounted via the use of the two mounting teeth 36, 42, in the manner in which it is described and would provide for a firm and solid mount.

As illustrated in FIG. 5, and as was discussed earlier, the lengths of body portions 30 and 40 respectively would be determined by the thickness of the window molding 50, and therefore the apparatus could be constructed with various lengths of body portions 30, 40. For the most part, as illustrated in FIG. 5, the teeth members 36 and 42 would engage the molding 50 along its rear face 55 that is secured against the wall or sheetrock 56, and would not necessarily have to dig into the molding, but would be substantially secured between the rear face 55 and the front face 53 of the window molding 50.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved curtain rod mounting bracket, comprising:

(a) a principal body portion for positioning against the face of molding surrounding a window where a curtain is to be hung;

(b) a bracket hook extending outwardly from the face, for securing the end of a curtain rod thereupon;

(c) a first mounting member extending rearwardly of the face of the body portion, and supported along the upper edge of the window molding;

(d) a second mounting member portion rearwardly from the principal body portion supported along the side edge of the window molding; and (e) means extending from the first and second body portions, for insertion into the window molding along the top edge and the side edge respectively so as to secure the bracket in position at the top corner of the molding when the body portions are supported against the top and side edge of the molding respectively.

2. The apparatus in claim 1, wherein the first mounting member extending rearwardly of the face with the body portion would further include a tooth member extending downward from the body member for insertion into the window molding.

3. The apparatus in claim 1, wherein the second body portion would further comprise a tooth member extending inwardly from the second body portion for insertion into the moding along the side edge of the window molding.

4. The apparatus in claim 1, wherein the apparatus would be engagable upon the left and right corners of the window molding and would be constructed in pairs.

5. The apparatus in claim 1, wherein there may be further included means for securing the apparatus onto the window molding via tacks along the edgezs of the window molding.

6. An improved curtain rod mounting bracket, comprising:

(a) a principal body portion for positioning against the face of molding surrounding a window where a curtain is to be hung;

(b) a bracket hook extending outwardly from the face, for securing the end of a curtain rod thereupon;

(c) a first mounting member extending rearwardly of the face of the body portion, and supported along the upper edge of the window molding;

(d) a second mounting member portion rearwardly from the principal body portion supported along the side edge of the window molding;

(e) a first tooth member extending downward from the end of the first mounting member for insertion into the top edge of the window molding;

(f) a second tooth member extending inwardly from the second mounting member and insertable into the window molding during the mounting of the mounting bracket.

7. The apparatus in claim 6, wherein during mounting of the apparatus, the first tooth member is inserted into the top edge of the window molding following the insertion of the second tooth member into the side edge of the window molding.

8. The apparatus in claim 6, wherein the mounting bracket mountable on the right corner of the window molding would require that the second mounting member and the bracket hook extend outwardly from the right edge of the principal body portion.

9. The apparatus in claim 6, wherein the mounting bracket positionable on the left corner of the window molding requires that the bracket hook and the second mounting member extend outwardly from the principal body portion along the left edge of the principal body portion.

* * * * *